US007967880B2

(12) United States Patent
Wünning

(10) Patent No.: US 7,967,880 B2
(45) Date of Patent: Jun. 28, 2011

(54) FIX BED GASIFIER WITH RADIANT HEATING DEVICE

(75) Inventor: Joachim A. Wünning, Leonberg (DE)

(73) Assignee: WS Reformer GmbH, Renningten (DE)

( * ) Notice: Subject to any disclaimer, the term of this patent is extended or adjusted under 35 U.S.C. 154(b) by 766 days.

(21) Appl. No.: 11/998,666

(22) Filed: Dec. 1, 2007

(65) Prior Publication Data

US 2008/0086945 A1 Apr. 17, 2008

Related U.S. Application Data

(63) Continuation-in-part of application No. PCT/EP2006/005320, filed on Jun. 2, 2006.

(30) Foreign Application Priority Data

Jun. 10, 2005 (DE) ..... 10 2005 026 764

(51) Int. Cl.
*C10J 3/30* (2006.01)

(52) U.S. Cl. ..... 48/86 R

(58) Field of Classification Search ..... 48/62 R–62 A
See application file for complete search history.

(56) References Cited

U.S. PATENT DOCUMENTS

| | | | | |
|---|---|---|---|---|
| 4,059,416 | A | 11/1977 | Matovich | |
| 4,455,153 | A | 6/1984 | Jakahi | |
| 4,583,992 | A * | 4/1986 | Rogers | 48/76 |
| 4,987,115 | A * | 1/1991 | Michel-Kim | 502/419 |
| 2002/0095866 | A1 * | 7/2002 | Hassett | 48/199 FM |

FOREIGN PATENT DOCUMENTS

| | | | |
|---|---|---|---|
| DE | 27 15 676 | A1 | 11/1977 |
| DE | 38 30 152 | A1 | 3/1990 |
| DE | 43 05 964 | A1 | 1/1994 |
| DE | 102 16 338 | A1 | 10/2003 |
| WO | WO 03/018720 | A2 | 3/2003 |

* cited by examiner

*Primary Examiner* — Alexa D Neckel
*Assistant Examiner* — Imran Akram
(74) *Attorney, Agent, or Firm* — R. S. Lombard; K. Bach

(57) ABSTRACT

The fixed-bed gasifier and method in accordance with the invention operates with a solid material batch that is perfused by air and/or steam in opposing direction. Compared with the resultant pyrolysis coke batch, the actual pyrolysis zone is thin enough so as to result in a material dwell time in the pyrolysis zone of only a few minutes, while the dwell time of the pyrolysis coke in the pyrolysis coke layer may last up to several hours. The pyrolysis occurs in an allothermic manner. High-energy low-dust and low-tar gas is formed. The process control can be automated in a reliable manner. The exhaust of reaction gases and pyrolysis gases occurs through the heating chamber, whereby the last tar components are eliminated.

18 Claims, 3 Drawing Sheets

FIX BED GASIFIER WITH RADIANT HEATING DEVICE

CROSS-REFERENCE TO RELATED APPLICATION

This is a continuation-in-part application of pending international application PCT/EP2006/05320 filed Jun. 2, 2006 and claiming the priority of German Application No. 10 2005 026 764.5 filed Jun. 10, 2005.

BACKGROUND OF THE INVENTION

The invention relates to a device for the pyrolysis of solid pyrolysis material, hereinafter referred to as "solid fuel". Furthermore, the invention relates to a method for the gasification of such solid fuel.

Solid fuel in the form of biological material, sewage sludge, carbon-containing residual materials, such as, for example, plastic materials, refuse, waste paper and the like, can be used for the production of gas. Smaller plants usually operate as fixed-bed gasifiers, whereby pieces of solid fuel present in a batch are subjected to pyrolysis. As a rule, such plants operate autothermically; that is, the energy required to achieve pyrolysis is generated by partially oxidizing the solid fuel. In professional literature, "Dezentrale Energiesysteme", Decentralized Energy Systems, published by Oldenbourg Verlag Munich Vienna 2004, pages 176 through 197, such gasifiers are described by Jürgen Karl. The wood gasifiers described there generate relatively low-energy combustion gases and, moreover, require monitoring personnel in most cases.

The object to be achieved by the invention is to provide an improved fixed-bed gasifier. Furthermore, a method for the gasification of solid fuel is to be provided, said method being suitable for small units and energy-rich pyrolysis gases.

SUMMARY OF THE INVENTION

The fixed-bed gasifier and method in accordance with the invention operates with a solid material batch that is perfused by air and/or steam in opposing direction. Compared with the resultant pyrolysis coke batch, the actual pyrolysis zone is thin enough so as to result in a material dwell time in the pyrolysis zone of only a few minutes, while the dwell time of the pyrolysis coke in the pyrolysis coke layer may last up to several hours. The pyrolysis occurs in an allothermic manner. High-energy low-dust and low-tar gas is formed. The process control can be automated in a reliable manner. The exhaust of reaction gases and pyrolysis gases occurs through the heating chamber, whereby the last tar components are eliminated.

The fixed-bed gasifier comprises a reaction chamber that holds the solid fuel. Said fuel forms a batch that has on its upper side a thin layer of pyrolysis material, solid fuel, and, underneath, pyrolysis coke, as well as ash at the bottom. The solid fuel layer is heated from the top—preferably by radiant heat—to such a degree that pyrolysis occurs. The pyrolysis material may be filled from the top through a fuel filling device, for example, which preferably includes a pipe with a shut-off or lock. Due to the thermal radiation coming from the heating chamber, the relatively thin pyrolysis zone on the surface of the batch is heated to the pre-specified temperature and degassed in an oxygen-deficient environment. The remainder of the pyrolysis coke and ash is withdrawn in downward direction, whereby the temperature remains essentially constant. The reasons being that the thermal radiation cannot penetrate deeply into the batch, and that the batch exhibits minimal thermal conductivity. The pyrolysis gases are withdrawn via the heating chamber, whereby the tar components are cracked. The batch may be perfused by steam, by air or by a mixture of steam and air, from the bottom to the top in order to gasify the pyrolysis coke.

The fixed-bed reactor is suitable for automatic operation with a constant load, as well as with fluctuating loads. It operates in an allothermic manner and generates energy-rich gas.

A stirring device, for example, configured as a slowly rotating stirring arm, is arranged in the reaction chamber and effects a uniform distribution of the pyrolysis material and the formation of a merely thin layer of pyrolysis material on the pyrolysis coke underneath said layer. The stirring device is preferably moved slowly enough so as to prevent material or dust vortices from occurring. In addition, the gas throughput is minimal enough so that no, or at least hardly any, dust is stirred up.

Preferably, the reaction chamber and the heating chamber are thermally insulated toward the outside. This improves the degree of effectiveness and permits at least a short-time stand-by operation without additional heating. If a longer stand-by operation is to be made possible, the reaction chamber may be provided with an auxiliary heater, for example, in the form of one or more gas burners or an electric heater.

The heating device that is provided in the heating chamber is preferably a jet pipe consisting of steel or ceramic, said pipe being equipped with a recouperator burner or a regenerator burner that maintains the temperature of the heating chamber preferably at 1000° C. to 1250° C. As a result of this, the tar components released by the pyrolysis material are cracked and, in the ideal case, completely separated into the gaseous components CO, $H_2$ as well as into some $CO_2$. To do so, the gas exhaust device is preferably arranged on the heating chamber. Furthermore, the mean dwell time of the pyrolysis gases in the heating chamber is preferably more than one second, thus aiding the extensive cracking of the tar components.

The gas exhaust device may contain a catalyst which aids the splitting of the hydrocarbons and their reformation into CO and $H_2$. Catalysts that can be used are nickel, coke, dolomite or the like.

A cooling device, preferably a shock-type cooling device, quench cooler, is provided on the gas exhaust device, said device preventing the formation of dioxin due to the rapid cooling of the product gas. The gas cooling device may be an air pre-heater or a steam generator, in which case the pre-heated air and/or the generated steam can be used to gasify the pyrolysis coke. In so doing, the operation may occur with a steam excess.

By heating the reaction chambers through jet pipes, slagging of the reaction chamber caused by low-melting ash components is prevented by consistently avoiding the stirring up of ash as a result of appropriately low gas velocities, in particular in the reaction chamber and in the heating chamber.

Considering a cost-effective modification, it is also possible to heat the heating chamber with a recouperator burner, from which the product gas is withdrawn. In this case, the temperature in the heating chamber can be controlled by supplying air at a sub-stochiometric level. However, a product gas having a lower heating value and a higher concentration of nitrogen is formed.

The heat supply into the pyrolysis zone can be controlled with a suitable device, for example, in the form of movable orifice plates. This allows an adaptation to varying heat demands during pyrolysis, for example, as a result of changing moisture contents, when biological material is used as the pyrolysis material.

Additional details of the invention are shown in the drawings, and set forth in the description and the claims. The drawings show two exemplary embodiments of the invention.

DESCRIPTION OF THE PREFERRED EMBODIMENT

Figure 1:
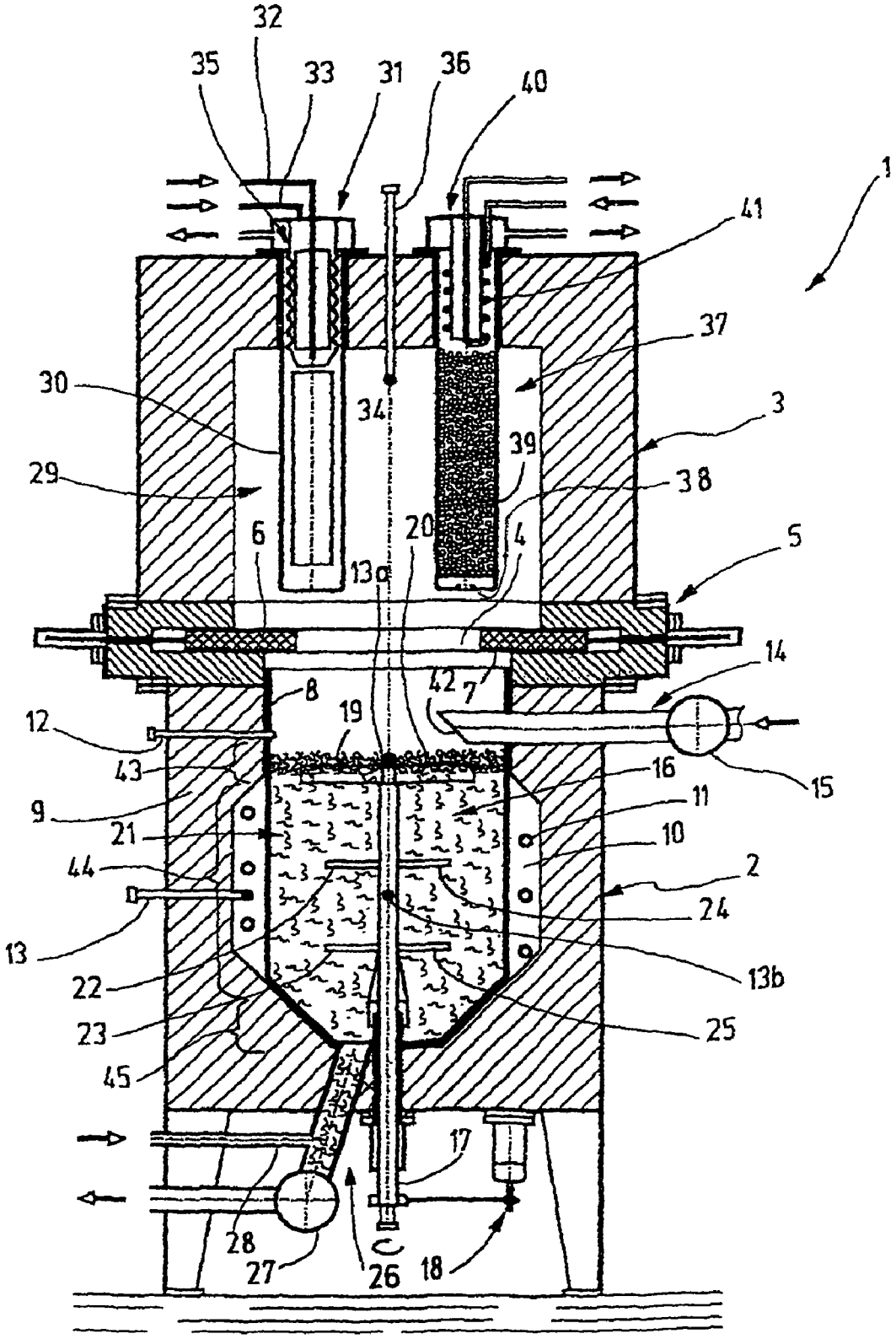
FIG. 1 is a schematic view, vertically in section, of the fixed-bed gasifier with jet pipe heating.

FIG. 1 shows a fixed-bed gasifier 1 which is used for the generation of carbon monoxide and hydrogen from pyrolysis material. Pyrolysis material that can be used is carbon-containing organic material that can be in chunks, shredded, in pellets or otherwise pre-conditioned. The fixed-bed gasifier is designed as a small-volume gas generator, for example, for the gasification of 20 kg to 100 kg of biological material per hour. The fixed-bed gasifier 1 comprises a gas-tight reaction chamber 2 that is approximately cylindrical on the outside and is thermally insulated toward the outside and, arranged above said gasifier, a thermally insulated heating chamber 3 that is also preferably approximately cylindrical on the outside and is closed at the top. A passage exists between the heating chamber 3 and the reaction chamber 2, said passage being referred to as the heating aperture 4. In order to define the heating aperture 4, a slider housing 5 may be provided, said housing 5 being located between the reaction chamber 2 and the heating chamber 3. Said housing 5 contains two rectangular orifice plates 6, 7 that are configured like sliders and can be moved in opposing directions to open and close aperture 4, said orifice plates being movable from the outside, that is, by an actuating drive or by hand, in order to control the passage of radiated heat from the heating chamber 3 into the reaction chamber 2.

The reaction chamber 2 is provided with a gas-tight lining 8. Between a heat-insulating external jacket 9 and the lining 8 is an intermediate space 10, wherein an auxiliary heating device 11 in the form of an electric heating coil or of gas burners may be provided in order to allow or to facilitate a stand-by operation. In order to monitor the operation, a filling level sensor 12 and a temperature sensor 13 may be provided. The filling level sensor 12 extends through the lining 8 and projects into the reaction chamber 2 just above the permissible maximum filling height. The temperature sensor 13 projects into the intermediate space 10.

A fuel filling device 14 is used for filling the reaction chamber 2 with pyrolysis material, said filling device, for example, comprising a filling pipe extending through the jacket 9 and through the lining 8 and further comprising a shut-off or lock 15. The fuel filling device 14 may contain a conveyor device, such as, for example, a worm conveyor or the like. Said conveyor device is disposed to load the pyrolysis material from the top onto the batch located in the reaction chamber 2.

Arranged inside the reaction chamber 2 is a stirring device 16. It has a shaft 17 that is arranged in the center relative to the reaction chamber 2, for example, said shaft extending through the floor of the container and slowly being rotated by means of a drive device 18. Radially extending in the horizontal direction from the upper end of the shaft 17 are one or more arms 19, 20 approximately at the height of the upper-most flat layer that has formed on the batch 21 in the reaction chamber 2. The arms 19, 20 act to distribute and flatten the filling material. The shaft 17 may be provided, at a lower level, with additional arms 22, 23, 24, 25 that are located approximately on the medium-height level of the batch. The stirring device 16 may comprise one or more temperature sensors 13*a*, 13*b* that are preferably arranged on the shaft 17. For example, the temperature sensor 13*a* is located on the height of the arms 19, 20, or above said arms, in order to detect the temperature in the center of the pyrolysis zone. The temperature sensor 13*b*, for example, is located on the shaft at approximately half the height of said shaft in order to detect the temperature in the gasification zone.

An ash withdrawal device, for example, in the form of a larger-diameter channel leading down and out is provided on the underside of the reaction chamber 2, said channel leading to a lock 27 and from there to ash disposal. In addition, air and/or steam are introduced from the underside, for example, via the ascending shaft belonging to the ash withdrawal device 26. To achieve this, the shaft is provided with an appropriate line 28. The steam supply and air supply may also terminate in the reaction chamber above the ash withdrawal device 26.

Arranged inside the heating chamber 3 is a heating device 29, which, in the present exemplary embodiment, is designed as a jet pipe 30 of steel or ceramic. The jet pipe 30, which is closed at the end, held on the upper side of the heating chamber 3 and hangs vertically in downward direction from said heating chamber 3 or even extends horizontally into said heating chamber, is heated from the inside by a burner, preferably a recouperator burner 31. Said jet pipe takes on a surface temperature between 1000° C. and 1400° C. and generates radiant heat. The recouperator burner 31 comprises a burner with a fuel supply line 32, an air supply line 33 and the recouperator 34 that acts as a heat exchanger and separates an exhaust gas channel 35 from a fresh air supply channel in order to heat the fresh air and cool the exhaust gas flowing in opposite direction.

Furthermore, the heating chamber 3 is associated with a temperature sensor 36 that detects the temperature of the heating chamber.

In addition, the heating chamber 3 is associated with an gas exhaust device 37, by means of which the gaseous reaction products are removed from the heating chamber 3. Referring to the present exemplary embodiment, the gas exhaust device 37 comprises an approximately cylindrical vessel hanging down from the upper side of the heating chamber and being closed on its underside, and being provided with a gas-receiving orifice 38. Said vessel containing a catalyst 39. Said catalyst is a batch of catalytically active particles, for example, of dolomite, coke or nickel. In addition, a gas-cooling device 40, for example, in the form of an evaporator 41, may be arranged inside said vessel. The evaporator, is a serpentine pipe, whereby the output gas stream of gaseous reaction products flows around said pipe and is passed through the air, the water or the air/water mixture. The resultant hot air, the resultant steam or the correspondingly formed mixture of hot air and steam is fed to the line 28 in order to promote gasification in the reaction chamber 2.

The fixed-bed gasifier operates as follows:

The batch 21 is replenished, continuously or from time to time, with pieces of solid fuel from the top through the fuel filling device 14. Said solid fuel falls out of the orifice 42 into a zone with sweeping arms 19, 20 and is spread by the arms 19, 20 to form a thin layer on the batch 21. A solid fuel layer 43 is being formed. The jet pipe 30 brings the temperature of the heating chamber 3 to preferably 1000° C. to 1250° C. The jet pipe 30 may be operated with gas, residual gases obtained from a chemical device connected to the fixed-bed gasifier 1, with gases removed from the heating chamber while bypassing the catalyst 39, with natural gas, or with other types of fuel. The radiant heat emitted by the jet pipe 30 and by miscellaneous heated parts of the heating chamber 3 moves through the heating aperture 4 and heats the solid fuel layer 43 to a pyrolysis temperature of 500° C. to 900° C., preferably approximately 650° C. The heat flux density is approximately 100 kW to 250 kW per square meter at the heating aperture 4. The temperature sensor 13*a* is disposed to have a detecting and regulating function in order to maintain the pyrolysis temperature in that a control device adjusts the orifice plates 7, 8 in such a manner that the pyrolysis temperature is within the desired range at all times. The temperature regulation is achieved by radiant heat control that responds very rapidly and exhibits minimal inertia. The temperature of the jet pipe 30 is not affected by the temperature regulation of the pyrolysis layer.

The solid fuel carbonizes in the solid fuel layer, whereby new solid fuel is replenished at all times, continuously or at intervals, through the orifice 42. The preferably continuously but very slowly moving, for example, 1 revolution/minute, arms 19, 20 evenly distributes said solid fuel. The resultant pyrolysis coke forms a pyrolysis coke layer 44 that is substantially more voluminous at the higher level, said coke layer also being moved smoothly and slowly by the arms 22 through 25. The coke which slowly migrates downward in the pyrolysis coke layer 44 carries along the heat from the solid fuel layer 43 and, in so doing, remains at an approximate temperature of from 600° C. to 700° C.

Steam or a steam/air mixture, or even preheated air, is introduced from the bottom at a minimal flow rate, whereby said steam or steam/air mixture, or even preheated air, gradually flows or seeps upward through the pyrolysis coke layer 44. In so doing, the pyrolysis coke is essentially converted into CO and $H_2$. While the carbonization in the solid fuel layer 43 is completed after one to two minutes, the reaction or gasification of the pyrolysis coke in the pyrolysis coke layer 44 takes one or several hours. The fixed-bed gasifier combines the rapid pyrolysis with the slow carbonization of coke. The regulation of the temperature in the pyrolysis coke layer 44 is achieved by means of the temperature sensor 13*b* and by the supply of steam and/or preheated air controlled by said temperature sensor, independent of the regulation of the temperature of the heating chamber and the regulation of the temperature in the pyrolysis layer 43.

The ash layer 45 accumulating under the pyrolysis coke layer 44 is removed continuously or occasionally through the ash withdrawal device 26.

Consequently, a mixture of low-temperature carbonization gases derived from the direct pyrolysis of the solid fuel in the solid fuel layer 43 and of reaction gases, carbon monoxide, hydrogen, derived from the pyrolysis coke layer 44 rises from the solid fuel layer 43 at a rate of a few centimeters per second. This gas mixture arrives in the heating chamber 3, where it does not pull along ash particles due to its minimal flow rate. In addition, the solid fuel layer 43 acts as a filter that contributes to the retention of the ash.

The rising gas initially contains a large proportion of tar components. By heating to over 1000° C. in the heating chamber 3, these tar components are cracked to form shorter-chain hydrocarbons and are at least partially oxidized and/or hydrogenated. The resultant gaseous reaction products contain only few tar components. The gas essentially consists of $H_2$, CO and some $CO_2$. This gas mixture is passed over the catalyst 39, where the last tar components are eliminated. The gaseous reaction products are quenched on the evaporator 41, thus avoiding dioxin formation.

For the operation of the system, the sensor 36 is used to set the temperature in the heating chamber 3, and the temperature sensor 13 is used to set the temperature in the reaction chamber 2. The heating chamber temperature is regulated by the recouperator burner 31. The reaction chamber temperature is regulated by the regulation of the added flow of steam through the line 28. The regulation of the filling level is achieved by the filling level sensor 12 that controls the fuel filling device 14. This ensures an automatic operation. The orifice plates 6, 7 may be used to adapt the solid fuel gasifier 1 to various fuel qualities.

Figure 2:
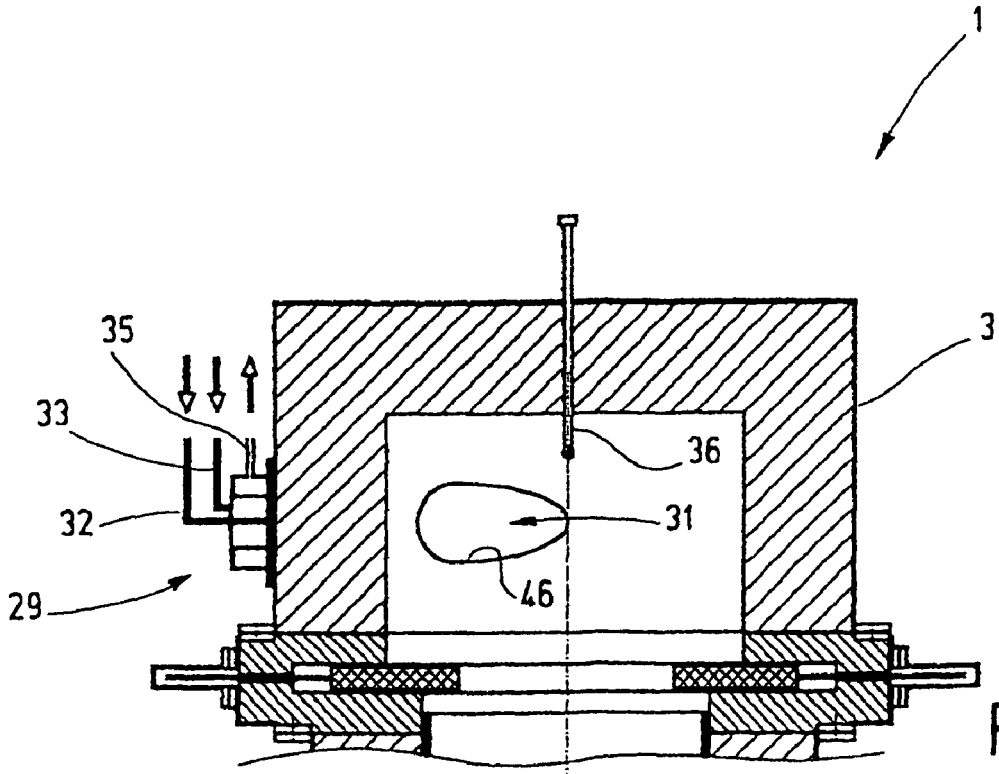
FIG. 2 is a schematic view, vertically in section, of the upper section of an alternative fixed-bed gasifier with burner heating.
Figure 3:
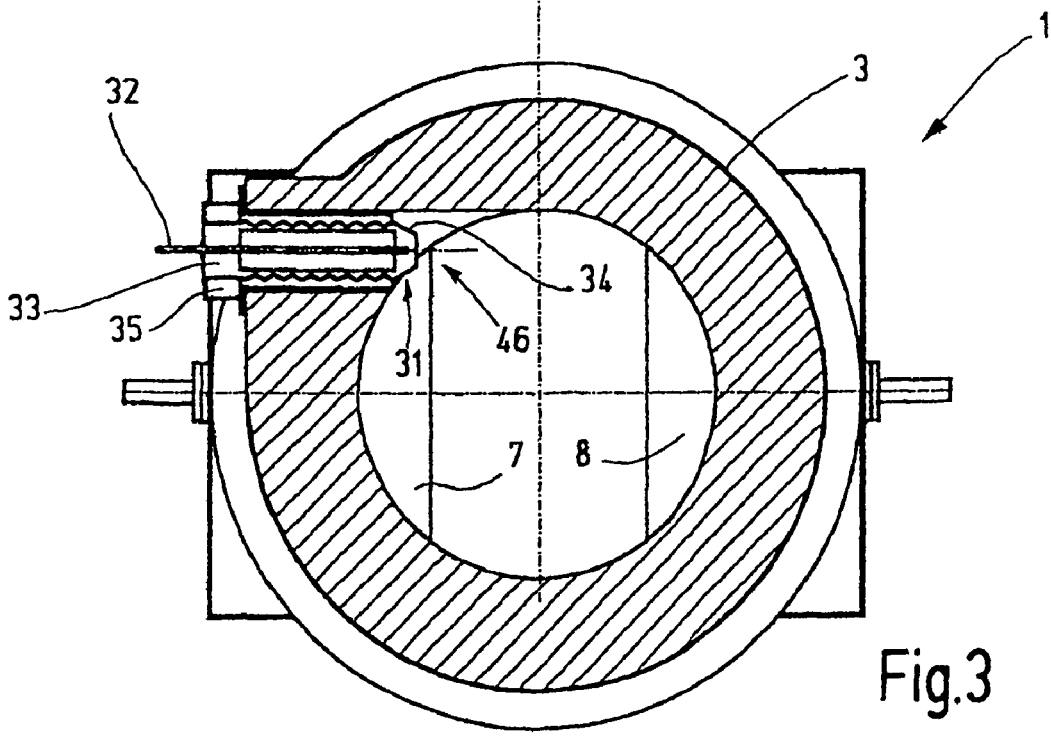
FIG. 3 is a horizontal section of the fixed-bed gasifier in accordance with FIG. 2, bisected at the height of said gasifier's burner; and, FIG. 4 is a modified embodiment of the fixed-bed gasifier.

FIGS. 2 and 3 show a modified embodiment of the fixed-bed gasifier 1. It differs from the previously described fixed-bed gasifier only regarding the configuration of the heating chamber 3. Regarding the design and function of the remaining elements, reference is made in full to the previous description.

The fixed-bed gasifier 1 in accordance with FIGS. 2 and 3 comprises a recouperator burner 31 instead of the jet pipe 30 as the heating device, said burner's flame reaching through an orifice 46 into the heating chamber 3. In so doing, the recouperator burner 31 is preferably arranged so as to be tangential to the cylindrical heating chamber 3. In this case, the gaseous reaction products are exhausted together with the exhaust gases of the recouperator burner 31 from the heating chamber 3 via the exhaust gas channel 35. The temperature in the heating chamber is controlled by a sub-stochiometric air supply. A product gas having a lower heating value and a higher nitrogen concentration is formed. Due to the tangential air supply, a helical-type flow occurs in the heating chamber 3, said flow causing the ash not to be stirred up from and out of the reaction chamber 2. The recouperator burner 31 can be operated with flameless oxidation. An air-preheating device and/or an evaporator may be connected to the exhaust gas channel 35 in order to generate hot air and/or steam for the reaction chamber 2.

Figure 4:
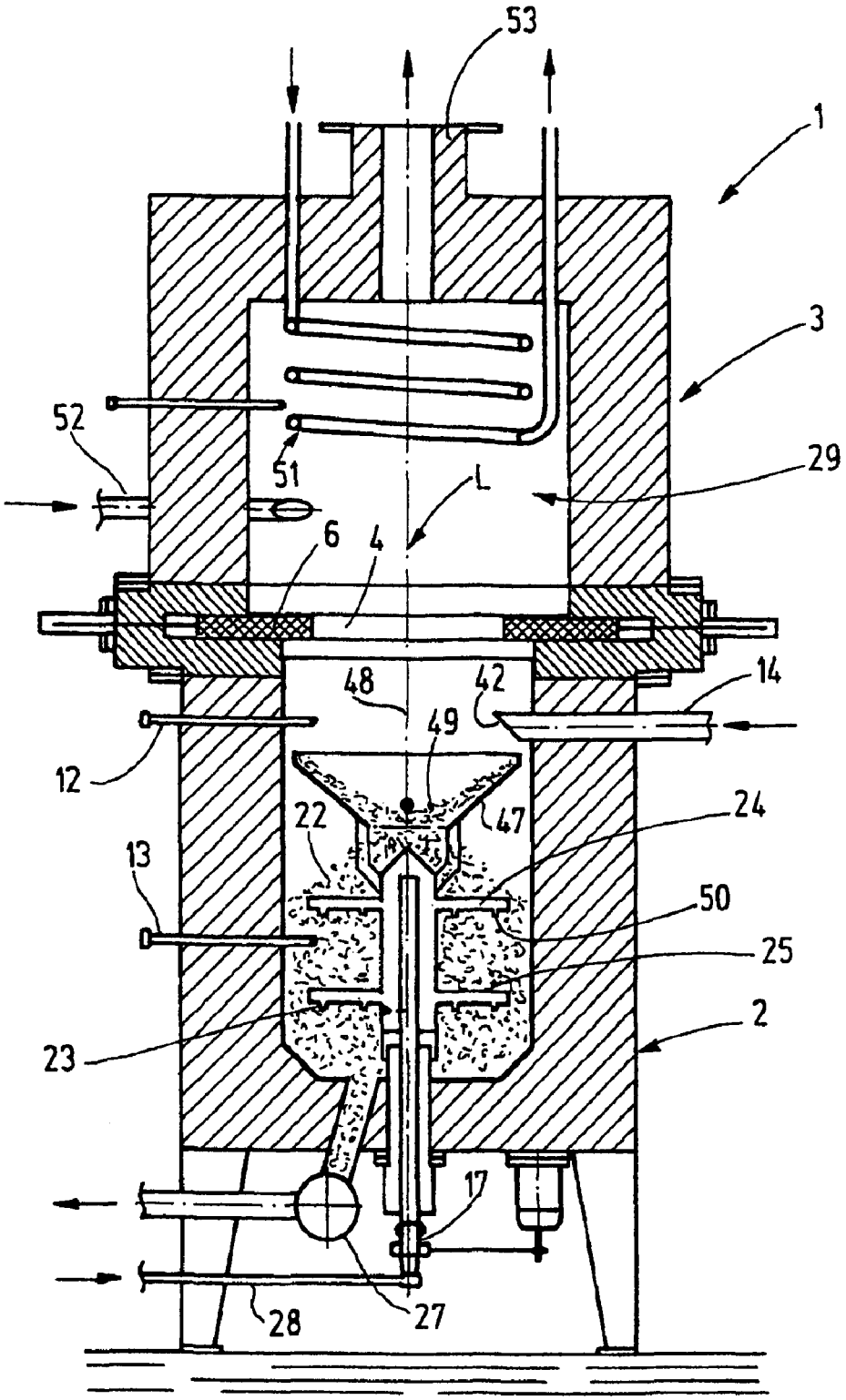

FIG. 4 shows a modified embodiment of the fixed-bed gasifier 1 in accordance with the invention. Arranged in the reaction chamber 2 is a turntable 47 which rotates continuously or intermittently about a central, preferably vertical, rotational axis 48. The turntable 47 is located under the orifice 42 and preferably has the shape of a funnel and is provided with a central hole 49. Said turntable may be connected to the shaft 17 and rotated by drive device 18. Filling of the turntable 47 can be scanned by a laser, or by another suitable means, and be used to regulate the supply of pyrolysis material. In accordance with FIG. 4, the laser beam L may be directed, for example, onto the hole 49. Other than that, the previous description is applicable. This embodiment has the advantage that fine particulate pyrolysis material constituents do not sink too rapidly in the batch and are thus exposed to the radiation for a sufficiently long time.

Furthermore, the stirring arms 22, 23, 24, 25 may be provided with nozzles 50 for the gasification agent, such as, oxygen and/or air and/or steam. Due to the achievable distributed input of the gasification agent achieved in this manner, any local overheating can be avoided.

In addition, a high-temperature heat exchanger can be used to heat a heat carrier 51, for example, for a Stirling engine or for a gas turbine, directly in the heating chamber 3. The exhaust heat can be used for preheating the air or for generating steam. Secondary air can be guided into the burning chamber 3 through a line 52. Exhaust gas can be discharged through a connecting piece 53 provided on the burning chamber 3.

The fixed-bed gasifier in accordance with the invention operates with a solid material batch that is perfused by air and/or steam in opposing direction. Compared with the resultant pyrolysis coke batch, the actual pyrolysis zone is thin enough so as to result in a material dwell time in the pyrolysis zone of only a few minutes, while the dwell time of the pyrolysis coke in the pyrolysis coke layer may last up to several hours. The pyrolysis is achieved more by the input energy radiation and less by the heat of reaction, and occurs in an allothermic manner. High-energy low-dust and low-tar gas is formed. The process control can be automated in a reliable manner. The exhaust of reaction gases and pyrolysis gases occurs through the heating chamber 3, whereby the last tar components are eliminated.

What is claimed is:

1. A fixed-bed gasifier (1) comprising a reaction chamber (2) for the accommodation of a batch (21) of solid fuel as well as of resultant pyrolysis coke and of resultant ash, the reaction chamber (2) having a top, the reaction chamber (2) comprises a gas-tight lining (8), an external jacket (9) surrounds gas-tight lining (8), the gas-tight lining (8) and the external jacket (9) having an intermediate space (10) therebetween, including an auxiliary heating device (11) housed within the intermediate space (10) and in operable arrangement with the reaction chamber (2), a fuel filling device (14) operatively positioned proximate the top of the reaction chamber (2), the fuel filling device (14) for filling the reaction chamber (2) with solid fuel from the top of the reaction chamber (2), an ash withdrawal device (26) for withdrawing ash in downward direction, a heating chamber (3) comprising an integral radiant heating device (29) for generating thermal radiation, the heating chamber (3) in thermal communication, via a heating aperture (4), with the reaction chamber (2) for heating by thermal radiation reaction chamber (2), the heating chamber (3) is positioned above the top of the reaction chamber (2); and, a gas exhaust device (37) for discharging resultant gaseous reaction products.

2. The fixed-bed gasifier in accordance with claim 1, wherein the reaction chamber (2) further includes a stirring device (16).

3. The fixed-bed gasifier in accordance with claim 1, wherein the reaction chamber (2) and the heating chamber (3) are thermally insulated toward the outside.

4. The fixed-bed gasifier in accordance with claim 1, wherein the heating device (29) is a jet pipe heating device.

5. The fixed-bed gasifier in accordance with claim 1, wherein the heating device (29) is a burner.

6. The fixed-bed gasifier in accordance with claim 1, wherein the gas exhaust device (37) is arranged on the heating chamber (3) and in fluid communication with the interior thereof.

7. The fixed-bed gasifier in accordance with claim 1, wherein the gas exhaust device (37) comprises a catalyst (39) for the splitting of hydrocarbons and aiding their reformation into CO and $H_2$.

8. The fixed-bed gasifier in accordance with claim 1, wherein the gas exhaust device (37) comprises a gas-cooling device (40).

9. The fixed-bed gasifier in accordance with claim 8, wherein the gas-cooling device (40) is a steam generator (41).

10. The fixed-bed gasifier in accordance with claim 1, wherein a gas input device (28) for the introduction of air or steam, or of a mixture of steam and air, is provided in fluid communication with the interior of the reaction chamber (2).

11. The fixed-bed gasifier in accordance with claim 1, wherein the heating aperture (4) is associated with a device for affecting the hot flow from the heating chamber (3) into the solid fuel.

12. The fixed-bed gasifier in accordance with claim 11, wherein said device includes adjustable orifice plates (6, 7).

13. The fixed-bed gasifier in accordance with claim 1, further including a temperature sensor (36) in operable arrangement with the heating chamber (3).

14. The fixed-bed gasifier in accordance with claim 1, further including a temperature sensor (13) in operable arrangement with the reaction chamber (2).

15. The fixed-bed gasifier in accordance with claim 1, further including a filling level sensor (12) in operable arrangement with the reaction chamber (2).

16. The fixed-bed gasifier in accordance with claim 1, further including a turntable (47) for the pyrolysis material operably supported within the interior of reaction chamber (2).

17. The fixed-bed gasifier in accordance with claim 16, wherein the turntable (47) is driven so as to rotate.

18. The fixed-bed gasifier in accordance with claim 16, wherein the turntable (47) has a funnel shape.

* * * * *